United States Patent [19]

Yeoman

[11] Patent Number: 4,795,144

[45] Date of Patent: Jan. 3, 1989

[54] SHEET MATERIAL HANDLING APPARATUS

[75] Inventor: Edwin H. Yeoman, West Chazy, N.Y.

[73] Assignee: AM International Incorporated, Chicago, Ill.

[21] Appl. No.: 46,049

[22] Filed: May 4, 1987

[51] Int. Cl.[4] ..... B65H 39/02; B65H 3/44

[52] U.S. Cl. ..... 270/58; 271/3.1; 271/9; 271/109; 271/146

[58] Field of Search ..... 271/3.1, 9, 224, 221, 271/207, 146, 109; 270/58; 414/37, 33, 32; 198/421, 456, 735, 644

[56] References Cited

U.S. PATENT DOCUMENTS

| | | | |
|---|---|---|---|
| 3,054,612 | 9/1962 | Godlewski | 270/58 |
| 3,466,026 | 9/1969 | Heigl | 270/58 |
| 3,519,264 | 7/1970 | Beacham et al. | 270/58 |
| 4,147,342 | 4/1979 | Naramore | 271/221 |
| 4,369,959 | 1/1983 | Hornbuckle | 271/3.1 |
| 4,371,156 | 2/1983 | Pessina et al. | 270/58 X |

*Primary Examiner*—Joseph J. Rolla
*Assistant Examiner*—Gregory L. Huson
*Attorney, Agent, or Firm*—Tarolli, Sundheim & Covell

[57] ABSTRACT

A sheet material handling apparatus includes a conveyor and a plurality of hoppers disposed along the conveyor for receiving sheet material. Each of the hoppers include a sheet material support surface which slopes downwardly at an acute angle relative to horizontal in a direction transverse to the conveyor and a register surface adjacent the support surface. Drums feed sheet material from the hopper to the conveyor. The drums are supported for rotation about axes which extend at an acute angle to horizontal in a direction transverse to the conveyor.

13 Claims, 2 Drawing Sheets

SHEET MATERIAL HANDLING APPARATUS

BACKGROUND OF THE INVENTION

1. Field of the Invention

The present invention relates to a sheet material handling apparatus. Specifically, the present invention relates to a sheet material handling apparatus having a plurality of feeders which deliver sheet material to a conveyor in an aligned relationship.

2. Description of the Prior Art

Collators for signatures, that is a single flat sheet, a single folded sheet or a plurality of folded sheets, are well known in the bindery art. A collator for signatures typically includes a plurality of feeders. Each of the feeders includes a hopper for supporting a stack of signatures so that each signature is supported in a generally horizontal orientation.

Each hopper may be supplied with signatures by a hopper loader. The hopper loader receives stacks of signatures, usually in a bundle form. The loader forms a stream of signatures in a continuous overlapped, or "shingled", relationship. The signatures are then delivered to the hopper one at a time to form a stack of signatures on a horizontal hopper support. Two such hopper loaders are disclosed in U.S. Pat. Nos 3,904,191 and 3,945,633.

In addition to a hopper, each of the signature feeders may include a rotatable drum. Grippers mounted on the drum remove one signature at a time from the bottom of the hopper as the drum rotates. The grippers release the signature to deposit, or deliver, the signature onto a conveyor which is moving along a path below the drum.

As the conveyor travels along the path below other feeders, additional signatures are deposited thereon to form a pile, or group, of signatures. The group of signatures can then be bound together to form a book, pamphlet, magazine, or the like. Two such known signature collators are disclosed in U.S. Pat. Nos. 3,525,516 and 3,825,247.

When the groups of signatures are bound together, it is imperative that the edges of the signatures are aligned. If the edges of the signatures are misaligned, the edges of the book, magazine, or pamphlet will not be uniform. Misalignment of the edges of the signatures may be the result of not having edges of the signatures properly aligned in the hopper.

When a signature is misaligned in the hopper, the misaligned orientation of the signature will be maintained as the signature is deposited onto a group of signatures on the conveyor. If a completed group of signatures containing the misaligned signature is bound, the resulting book, magazine or pamphlet will be unsatisfactory in appearance.

SUMMARY OF THE INVENTION

The present invention provides a new and improved apparatus for handling sheet material. The apparatus minimizes the possibility of assembling groups of signatures having a misaligned signature. This is accomplished by supporting the signatures in a feeder hopper on a support surface which slopes downwardly toward a register surface. The downward slope of the support surface promotes engagement of the signatures in the hopper with the register surface.

Alignment of the signatures is further promoted by supporting a feeder drum for rotation about an axis which slopes downwardly. Thus, signatures are fed from the downwardly sloping support surface of the hopper to a conveyor by the drum which rotates about an axis which slopes downwardly in the same direction as the signature support surface of the hopper. The conveyor may advantageously have a signature support surface which slopes downwardly to still further promote alignment of the edge portions of the signatures.

BRIEF DESCRIPTION OF THE DRAWINGS

Further features of the present invention will become apparent to those skilled in the art to which the present invention relates from a reading of the following specification made with reference to the accompanying drawings, in which.

DESCRIPTION OF A PREFERRED EMBODIMENT

Figure 1:
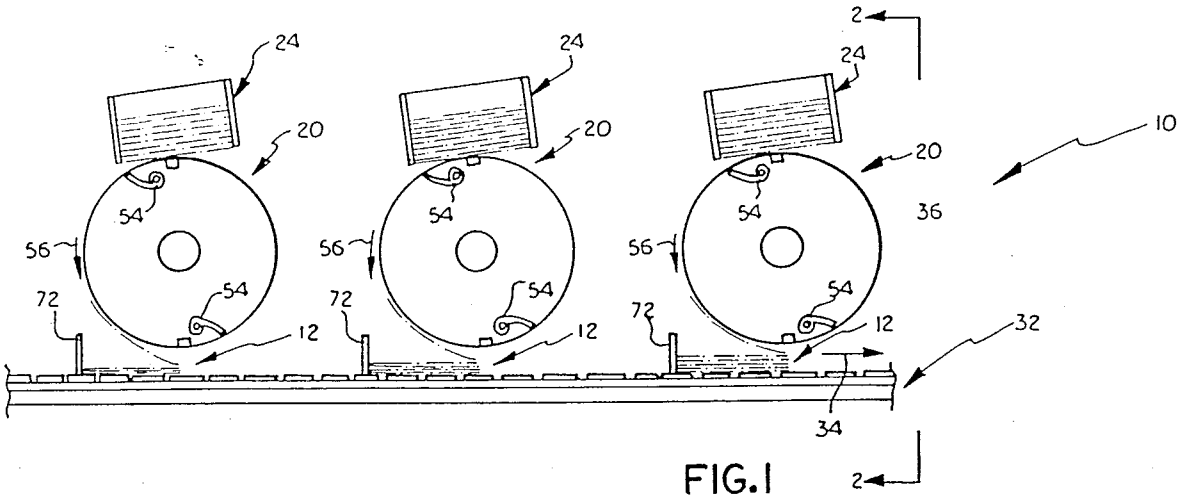
FIG. 1 is a schematic illustration of a signature handling apparatus constructed in accordance with the present invention and having a conveyor which extends past a pluality of signature feeding stations.

A sheet material handling apparatus or collator 10, embodying the present invention, is illustrated schematically in FIG. 1. The signature collator 10 forms stacks of signatures 12 which are further processed into books, pamphlets, magazines or the like. The stacks of signatures 12 are progressively formed at successive feeding stations 20.

At each of the feeding stations 20, a signature 22 is fed from an associated hopper 24. The signature 22 is deposited onto a conveyor 32 which moves stacks of signatures 12 along a path, in a direction indicated by the arrow 34, below the feeding stations 20. Although the signatures 22 are illustrated as a single folded sheet, it will be apparent that the signatures could be a single flat sheet or a plurality of folded sheets.

At each of the feeding stations 20 (FIG. 2) there may be a hopper 24, a hopper loader 35 and a drum 36. The hopper loader 35 receives signatures 22 in the form of a bundle (not shown). The hopper loader 35 breaks down the bundle and feeds the signatures 22 into the hopper 24 one at a time along a path in the direction 38 extending transversely to the path 34 of movement of the conveyor 32.

Each of the signatures 22 (FIG. 3) has a folded edge portion 42, a pair of sheet sections 44 extending therefrom, and an open edge portion 46. The folded edge portion 42 of each of the signatures 22 leads, relative to the path 38, as the signature is fed to the left, as viewed in FIG. 2, into the hopper 24.

The signatures 22 are fed onto a support 52 of the hopper 24. The support 52 includes a flat upper surface on which the signatures 22 are supported. The upper surface of the support 52 is disposed at an acute angle relative to the horizontal, indicated by the plane B. A lowermost edge portion 53 of the support 52 is disposed in the direction 38 of movement of the signature 22.

Figure 4:
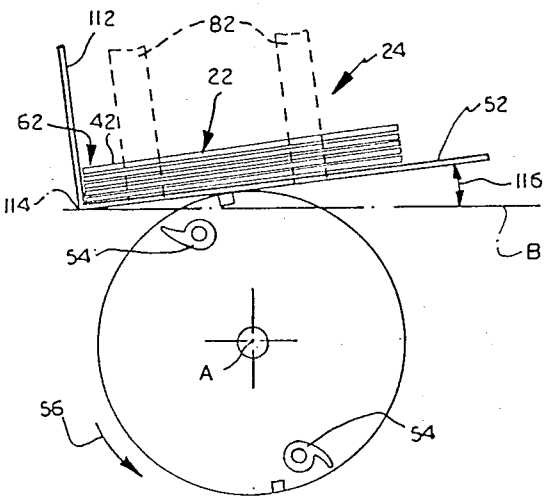
FIG. 4 is a schematic illustration, taken generally along the line 4—4 of FIG. 3 of the hopper and drum.

The drum 36 is supported at the feeding station 20 for rotation about the longitudinal axis A of the drum. The drum 36 includes a pair of gripper mechanisms 54 (FIGS. 1 and 4). The bottom signature 22 in the hopper 24 is separated from the stack by a known separator disc (not shown). As the drum 36 rotates counterclockwise, as viewed in FIG. 4 and indicated by the arrow 56, one of the gripper mechanisms 54 engages an edge portion 62 extending from the folded edge portion 42 of the separated signature 22. The gripper mechanism 54 removes the separated signature 22 from the hopper 24, as is known. One such separator and gripper mechanism is disclosed in U.S. Pat. No. 3,650,525.

The signature 22 is then stored temporarily on the outer circumference of the drum 36 as the drum rotates in the direction 56. The gripper mechanism 54 is actuated by a known cam device (not shown) and releases the signature 22 in a timed relationship with the conveyor 32 moving in the direction 34. Thus, a signature 22 is deposited on a respective stack 12, in turn, under each feeding station 20.

The conveyor 32 includes a plurality of pockets movable along the path 34 by a chain (not shown), as is known. Each of the pockets include a peg 72 connected with the chain. As each signature 22 is deposited onto the conveyor 32 under a respective feeding station 20, the peg 72 engages the signature to move the signature along the conveyor path 34.

The hoppers 24 and drums 36 are supported by the signature collator 10 at a mounting 76. Each of the drums 36 is driven by an appropriate drive 78, such as belts and pulleys, or chains and gears. The hopper loader 35 may be of the portable type or be permanenently affixed to each of the feeding stations 20.

Each of the hoppers 24 also includes a guide or register member 82 (FIG. 3) connected with the support 52. The guide 82 extends perpendicularly from the edge portion 53 of the support 52. The guide 82 engages an edge portion 42 of the signatures 22 to provide an alignment register for the signatures.

Figure 2:
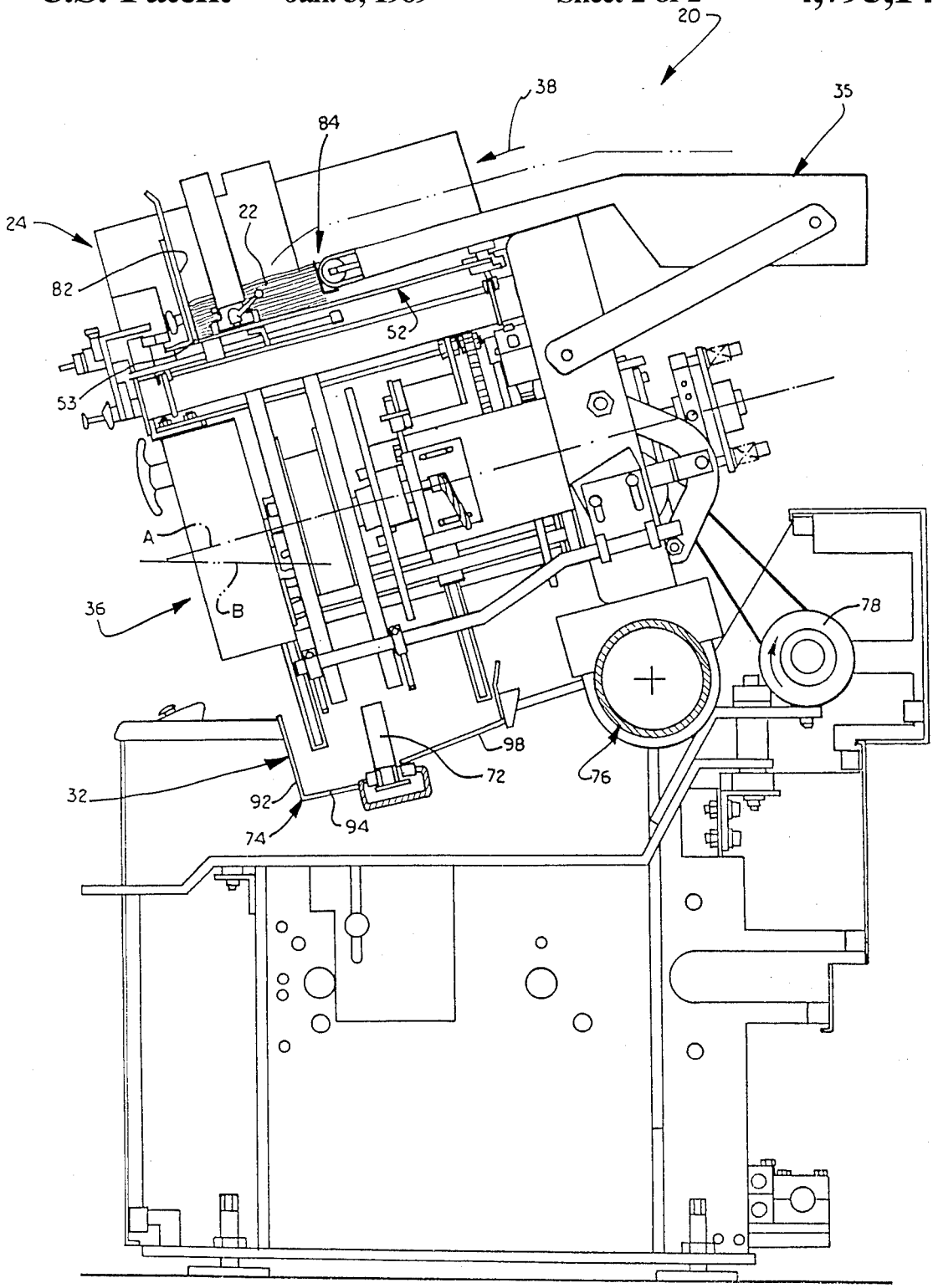
FIG. 2 is a side elevational view, taken generally along the line 2—2 of FIG. 1, illustrating the construction of a signature handling apparatus at one of the signature feeding stations.

Each hopper loader 35 also includes a jogger mechanism 84 (best seen in FIG. 2). The jogger mechanism 84 vibrates to align the folded edge portions 42 of the signatures against the guide 82. The jogger mechanism 84 vibrates to move the signatures 22 relative to one another to overcome the frictional forces acting between adjacent sheet sections 44 of the signatures which tend to prevent the signatures from sliding so that the folded edge portions 42 align against the guide 82. While a jogger mechanism 84 has been described, its use is limited because of the features described below, and could be eliminated altogether.

Figure 3:
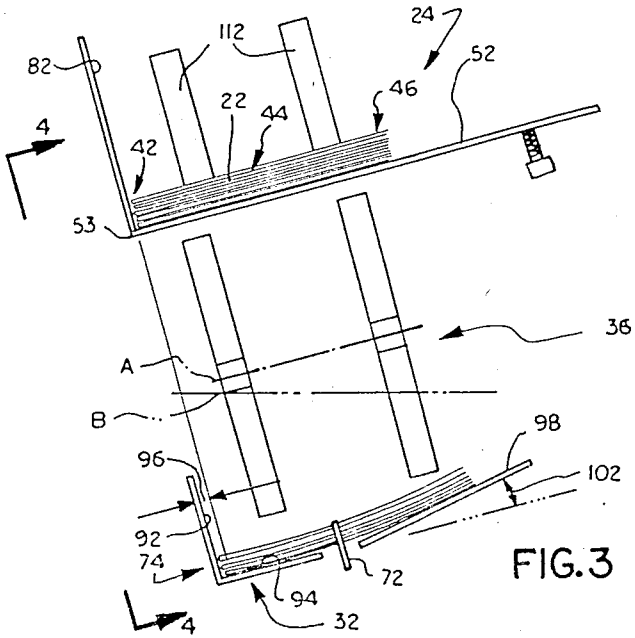
FIG. 3 is a schematic side elevational view, corresponding to FIG. 2, illustrating a hopper, drum and raceway of the signature handling apparatus.

The signature support 52, at the bottom of each of the hoppers 24 is disposed at an acute angle relative to a horizontal surface, such as a floor or other support, indicated by the plane B (FIGS. 2 and 3). The signature support 52 slopes downwardly in a direction perpendicular to the central axis of the conveyor 32 and the path 34 along which signatures are moved by the conveyor. This acute angle is illustrated as being approximately 15 degrees in the preferred embodiment. However, it will be apparent that other acute angles may be used depending on various factors. It is anticipated that acute angles of up to 30 degrees may be used to provide the desired registration of the folded edges 42 of the signatures 22.

The support 52 is disposed at the acute angle relative to the horizontal B so that gravity aids in overcoming the frictional forces existing between adjacent sheet sections 44 of the signatures 22. If an edge portion 42 of a signature 22 is aligned with other edge portions of other signatures in the hopper 24, a better quality and more uniform stack 12 of signatures is formed. Furthermore, by using gravity to align the folded edge portions 42 of the signatures 22 against the guide 82, less energy and time is consumed by the jogger mechanism 84 to aid in aligning the folded edge portions against the guide 82. Thus, the collator 10 made in accordance with the present invention is not hampered by the time delay and energy cost associated with operating the jogger mechanism 84 for relatively long periods of time to align the folded edges 42 of the signatures. Therefore, the collator 10 can be operated faster due to the reduced time required to align the signatures 22.

As illustrated in FIG. 3, the axis of rotation A of the drum 36 is disposed at the same acute angle relative to the horizontal plane B as the support 52. Thus, the axis A about which the drum 36 rotates slopes downwardly in a direction perpendicular to the central axis of the conveyor 32 and the path 34 along which signatures are moved by the conveyor. This permits the grippers 54 of the drum 36 to engage the edge portion 62 of the signature 22 without major redesign to any of the components of the feeding station 20 or collator 10.

The conveyor 32 also includes a stationary raceway 74 (FIG. 3) which supports the signatures 22 in an aligned relationship for movement along the path 34. The raceway 74 has a stationary guide surface 92 and a stationary support surface 94. The guide surface 92 extends perpendicularly from the support surface 94. The guide surface 92 of the raceway 74 is downwardly offset relative to a plane extending through the guide 82 of the hopper 24 a predetermined distance as illustrated by the offset 96. The offset 96 is at least 0.100 inch. The offset 96 is used for countering the effect of gravity which tends to move the signature downwardly and to the left, as viewed in FIG. 3, when it is released by the gripper mechanism 54 during rotation of the drum 36.

The guide surface 92 is used to engage the folded edge portions 42 of the signatures 22 and to align the folded edge portions to provide a quality uniform stack of signatures 12 which are suitable for further binding operations without further aligning of the edges. When uniform and evenly aligned edges are presented for further binding operations, reduced costs are realized because subsequent operations are not required in order to align the edges to provide a good quality book, pamphlet, magazine or the like which has a pleasing appearance.

The support surface 94 of the raceway 74 is disposed at an acute angle relative to the horizontal B. The acute angle at which the support surface 94 is disposed is approximately the same angle at which the support 52 and drum 36 are disposed relative to the horizontal B. The raceway 74 also includes a second support portion 98. The second support portion 98 is disposed at a second acute angle 102 relative to the first support portion 94. The second angle at which the second support portion 98 of the raceway 74 extends relative to horizontal B is greater than the angle at which the first support portion 94 extends.

The second angle 102 at which the second support portion 98 is disposed further utilizes gravity to act upon each signature 22 forcing the signature to engage the guide surface 92 as the signature is moved along the conveyor 32. That is, the second support portion 98 tilts the signatures 22 so that the vertical component of the weight of the signature forces the folded edge portions 42 of signatures towards the guide surface 92. Also, the movement of the stacks 12 along the conveyor path 34 vibrates the signatures 22 somewhat which "jogs" them and aligns them against the guide surface 92. This also tends to produce a more uniform and even alignment of the folded edge portion 42 of the signatures 22 which form the stacks 12.

As illustrated in FIG. 4, the support 52 of the hopper 24 may also be tilted in a second direction relative to the horizontal B but parallel to the path 34 of movement of the conveyor 32. The support 52 is essentially rotated about an edge 114 at another acute angle 116. The acute angle 116 is less than the acute angle between the axis A and horizontal B as illustrated in FIG. 3. In a preferred embodiment, this angle is approximately 6 degrees, but other angles up to 15 degrees is anticipated for use.

A second guide 112 is connected with the support 52 at the edge 114. The support 52 disposed at angle 116 about the corner 114 again uses gravity acting on the weight of the signatures 22 to align edges 62 of the signatures against the guide 112. This permits the gripper mechanisms 54 of the drum 36 to remove signatures 22 from the same relative location on the support during subsequent gripper cycles of the drum 36. A more uniform delivery of the signatures 22 onto the conveyor 32 having the edges 62 of the stack 12 aligned relative to the peg 72 is thus achieved.

In view of the foregoing description, it is apparent that the sheet material handling apparatus 10 (FIG. 1) includes a longitudinally extending conveyor 32 which sequentially moves through feeding stations 20. At each of the feeding stations 20 there is a hopper 24 which receives signatures, that is, sheet material, from a hopper loader 35 (FIG. 2).

In accordance with a feature of the invention, each of the hoppers 24 has a signature planar support panel 52 which slopes downwardly at an acute angle relative to a horizontal plane B in a direction perpendicular to the longitudinal central axis of the conveyor 32. Thus, as each of the signatures enters a hopper 24, it moves downwardly toward a flat side surface of a register member 82. The register member 82 engages the folded edge portion 42 of the signature 22 to register the signature relative to the support surface 52. The register surface on the member 82 extends perpendicular to the support 52. The downwardly sloping orientation of the support 52 promotes engagement of the folded edge portions 42 of the signatures 22 with the register member 82 so that the edges of the signatures are aligned.

In accordance with another feature of the present invention, the axis of rotation A in the feed drum 36 extends parallel to the support 52. This enables the grippers 54 on the drum 36 to obtain a firm grip on signatures 22 supported on the downwardly sloping bottom panel 52 of the hopper 24 and to smoothly pull a gripped signature out of the hopper. The axis A of rotation of the drum 36 slopes downwardly toward the conveyor 32 at an acute angle to the horizontal plane B and in a direction perpendicular to the longitudinal central axis of the conveyor.

The conveyor 32 has a signature support surface 94 which extends parallel to the axis A of the drum 36 and the support 52 of the hopper 24 (FIG. 3). Thus, the conveyor support surface 94 slopes downwardly at an acute angle toward the horizontal plane B in a direction perpendicular to the longitudinal central axis of the conveyor 32. The downwardly sloping orientation of the conveyor support surface 94 promotes engagement of lower edge portions of signatures with the register or guide surface 92.

As a result of the construction of the hopper 24, drum 36 and conveyor 32, the folded or lower edges of the signatures 22 (FIG. 3) are aligned with each other. Thus, the downwardly sloping support surface 52 in the hopper 24 promotes engagement of the folded edges 42 of the signatures with the register surface on the member 82. Since the drum 36 rotates about an axis A which slopes downwardly at the same angle as the bottom panel 52 of the hopper 24, the registered or aligned orientation of the signature is maintained as the drum transfers the signature from the hopper 24 to the conveyor 32. The downwardly sloping signature support panel 94 of the conveyor 32 promotes engagement of the lower edge portion of the signature with the register surface 92. The result of these combined effects is that the sheet material handling apparatus 10 can be operated at a relatively high speed and still have the edges of the signatures 22 aligned with each other.

Although the hopper 24 and drum 36 of the signature feeding apparatus at only one station along the conveyor 32 has been shown in FIG. 2, similar signature feeding apparatus is disposed at each of the stations. Signature supports 52 in the hoppers 24 at each of the feeding stations slope downwardly at the same angle relative to the horizontal plane B. Similarly, the drum 36 at each of the feeding stations extend parallel to the signature supports 52 and to each other. Although the signatures 22 are folded sheets, the signatures could be a single flat unfolded sheet or a plurality of folded and/or unfolded sheets.

From the above description of a preferred embodiment of the invention, those skilled in the art will perceive improvements, changes and modifications. Such improvements, changes and modifications within the skill of the art are intended to be covered by the appended claims.

Having described a preferred embodiment of the invention, I claim:

1. A sheet material handling apparatus comprising a conveyor for transporting sheet material, a plurality of hopper means disposed along said conveyor for receiving sheet material, each of said plurality of hopper means including a sheet material support surface which slopes downwardly at an acute angle to a horizontal plane and in a direction transverse to a direction in which sheet material is transported by said conveyor and register surface means dispose adjacent to a lower end portion of said support surface for registering edge portions of sheet material supported by said support surface, a plurality of drum means for transferring sheet material from said hopper means to said conveyor, and a plurality of support means for supporting said plurality of drum means for rotation about axes which are spaced apart along said conveyor, each of said plurality of support means supporting each of said drum means with its axis of rotation sloping downwardly at an acute angle to a horizontal plane and in a direction transverse to the direction in which sheet material is transported by said conveyor.

2. A sheet material handling apparatus as set forth in claim 1 wherein each of said support surfaces slopes downwardly at an acute angle which is the same as the acute angle at which the axis of rotation of an associated one of said drum means slopes downwardly.

3. A sheet material handling apparatus as set forth in claim 1 further including sheet material feed means for feeding sheet material into said plurality of hopper means toward said register surface means, said register surface means in each of said plurality of hopper means extending perpendicular to said support surface means.

4. A sheet material handling apparatus as set forth in claim 1 wherein said plurality of drum means are supported by said plurality of support means with the axes of rotation of said plurality of drum means extending parallel to each other so that the axes of rotation of said plurality of drum means all extend at the same acute angle to a horizontal plane.

5. A sheet material handling apparatus as set forth in claim 4 wherein said sheet material support surfaces of said plurality of hopper means extend parallel to the axes of rotation of said plurality of drum means so that said sheet material support surfaces all extend at the same acute angle to a horizontal plane as the axes of rotation of said plurality of drum means.

6. An apparatus comprising:

a series of hoppers, each of said hoppers including a first register surface and a support for supporting signatures with a first edge of each of the signatures engaging the register surface, said support including a signature support surface extending at a first acute angle relative to a horizontal plane;

a series of drums for feeding signatures from said series of hoppers, each of said series of drums including a gripper for gripping a second edge of each of the signatures;

means supporting said series of drums for rotation about axes which extend at the first acute angle; and a conveyor onto which signatures are fed by said series of rums, said conveyor having a second register surface for engaging the first edge of each signature.

7. An apparatus as defined in claim 6 further including a jogger connected with said support for vibrating said support to align the first edge of each of the signatures dispose on said support into engagement with said first register surface.

8. An apparatus as defined in claim 6 wherein the first acute angle is less than 30 degrees.

9. An apparatus as defined in claim 6 wherein said conveyor includes a support portion extending at the first acute angle to a horizontal and a second support portion extending at a third acute angle to the horizontal which is greater than the first acute angle.

10. An apparatus as defined in claim 6 wherein said second register surface extends in a first plane parallel to a second plane in which said first register surface extends, said first plane being offset downwardly along the acute angle relative to said second plane.

11. An apparatus as defined in claim 7 wherein said first plane is downwardly offset relative to said second plane at least one-tenth of an inch.

12. An apparatus as defined in claim 6 wherein said support is disposed so that the first edge of each of the signatures engaging the register surface lies at a second acute angle to the horizontal, said second acute angle lying in a plane perpendicular to the axis of rotation of said drum.

13. An apparatus as defined in claim 12 wherein said second acute angle is substantially equal to said first acute angle.

* * * * *

UNITED STATES PATENT AND TRADEMARK OFFICE

CERTIFICATE OF CORRECTION

PATENT NO. : 4,795,144

DATED : January 3, 1989

INVENTOR(S) : Edwin H. Yeoman

It is certified that error appears in the above-identified patent and that said Letters Patent is hereby corrected as shown below:

Column 6, line 67, change "associated" to -- adjacent --.

Column 8, line 2, Change "rums" to -- drums --.

Column 8, line 22, change "7" to -- 10 --.

Signed and Sealed this

Eleventh Day of July, 1989

*Attest:*

DONALD J. QUIGG

*Attesting Officer*

*Commissioner of Patents and Trademarks*